US010151208B2

(12) United States Patent
Hein et al.

(10) Patent No.: US 10,151,208 B2
(45) Date of Patent: Dec. 11, 2018

(54) GUIDE VANE ARRANGEMENT

(71) Applicant: MTU Aero Engines AG, Munich (DE)

(72) Inventors: Manuel Hein, Karlsfeld (DE); Markus Uecker, Munich (DE); Rudolf Stanka, Rattenkirchen (DE)

(73) Assignee: MTU Aero Engines AG, Munich (DE)

( * ) Notice: Subject to any disclaimer, the term of this patent is extended or adjusted under 35 U.S.C. 154(b) by 1124 days.

(21) Appl. No.: 14/244,668

(22) Filed: Apr. 3, 2014

(65) Prior Publication Data

US 2014/0301840 A1 Oct. 9, 2014

(30) Foreign Application Priority Data

Apr. 3, 2013 (EP) ..... 13162067

(51) Int. Cl.
*F01D 9/04* (2006.01)
*F01D 25/24* (2006.01)

(52) U.S. Cl.
CPC ..... *F01D 9/042* (2013.01); *F01D 9/041* (2013.01); *F01D 25/246* (2013.01); *F05D 2230/232* (2013.01); *F05D 2230/30* (2013.01)

(58) Field of Classification Search
CPC ..... F01D 25/246; F01D 9/041; F01D 9/042; F05D 2230/232; F05D 2230/30
USPC ..... 415/209.2, 174.2
See application file for complete search history.

(56) References Cited

U.S. PATENT DOCUMENTS

| | | | | |
|---|---|---|---|---|
| 5,127,793 | A * | 7/1992 | Walker | F01D 11/08 415/115 |
| 2009/0169370 | A1* | 7/2009 | Morgan | F01D 11/005 415/174.2 |
| 2011/0127352 | A1* | 6/2011 | Fachat | F01D 11/001 239/265.15 |
| 2012/0219726 | A1* | 8/2012 | Bayer | B22F 3/1055 427/551 |

* cited by examiner

*Primary Examiner* — Mark Laurenzi
*Assistant Examiner* — Paul Thiede
(74) *Attorney, Agent, or Firm* — Crowell & Moring LLP

(57) ABSTRACT

A guide vane arrangement for a turbomachine, particularly a gas turbine, is disclosed. The guide vane arrangement includes an external shroud band, on which at least two guide vanes protrude radially inward. A pair of axial ribs spaced apart from each other in the peripheral direction and disposed between two adjoining guide vanes in the peripheral direction protrude radially outward from a circumferential surface of the external shroud band and/or axially from a radial flange of the external shroud band.

10 Claims, 1 Drawing Sheet

GUIDE VANE ARRANGEMENT

This application claims the priority of European Patent Application Document No. EP 13162067.6, filed Apr. 3, 2013, the disclosure of which is expressly incorporated by reference herein.

BACKGROUND AND SUMMARY OF THE INVENTION

The present invention relates to a guide vane arrangement for a turbomachine, particularly a gas turbine, as well as a gas turbine, particularly an aircraft engine gas turbine, with one or more of such guide vane arrangements.

Guide vane arrangements particularly in aircraft engine gas turbines are subjected to high thermal loads. Therefore, it is known from internal operating practices to provide cooling slits in the rear radial flange of external shroud bands of such guide vane arrangements, through which cooling air flows when in operation to cool the guide vane arrangements and/or a housing, in which these are arranged.

Such cooling slits represent a possible source of component cracks.

An object of an embodiment of the present invention is to provide an improved turbomachine, particularly an improved gas turbine.

According to an aspect of the present invention, a gas turbine, particularly an aircraft engine gas turbine, has one or more compressors and/or turbine stages, particularly low-pressure compressors and/or turbine stages, each having a guide vane arrangement.

A guide vane arrangement has, according to an aspect of the present invention, a single- or multi-section external shroud band, from which two or more guide vanes protrude radially inward. The guide vanes may be connected detachably or permanently to the external shroud band, in particular produced integrally with it or connected to it in a firmly bonded, particularly welded, manner.

In an embodiment, the external shroud band has, in particular at least an essentially conical circumferential surface and at least a radial flange, particularly a rear radial flange in the flow direction and/or a front radial flange in the flow direction. In an embodiment, the guide vane arrangement is connected, particularly in a detachable and/or form-locking manner, by means of at least one radial flange, particularly by a rear radial flange and/or a front radial flange, to a housing or preferably hung into it.

In an embodiment, seen in the peripheral direction, there is arranged between at least one pair of adjoining guide vanes—in an enhanced embodiment between all guide vanes of the guide vane arrangement—a pair of axial ribs which are spaced apart from each other in the peripheral direction and protrude from the circumferential surface of the external shroud band radially outward or to the side facing away from the guide vanes. Additionally or alternatively, the axial ribs of at least one, particularly the rear and/or front, radial flange of the external shroud band may protrude axially toward the circumferential surface. In an embodiment, the axial ribs are connected in a firmly bonded manner to the circumferential surface and/or at least one, particularly a rear and/or a front, radial flange.

By means of the axial ribs, possible crack propagation in an embodiment can be advantageously controlled between the axial ribs and thus limited to a certain region of the exterior platform. In particular, in an enhanced embodiment, crack propagation in a region in which a guide vane is arranged can be impeded, preferably stopped, and thus be directed to regions more favorable for this.

In an embodiment, a radial flange, particularly a rear one, has one or more recesses. These may be formed particularly in a slit-type manner and/or be produced by electrical discharge machining (EDM) and/or extend at least essentially in a radial direction, particularly out from a radial external border of the radial flange. In an embodiment, they are intended or constructed, as the case may be, for being passed through by a cooling fluid, particularly cooling air.

As explained in the introduction, such recesses, particularly radial inner ends of slit-type recesses, form incipient crack locations favored as a result of the notch effect.

Therefore in an embodiment, the axial ribs of an axial rib pair of adjoining axial ribs extend radially outward at least to a radially inner end of a recess, particularly a cooling slit, in a radial flange, particularly a rear one. In an embodiment, they are, when seen in a peripheral direction, arranged on both sides of the recess or the recess is arranged in the peripheral direction between the two adjoining axial ribs of an axial rib pair. In this way, possible crack propagation in an embodiment can be limited already at its source between the axial ribs and be directed by these to the radial flange and further into the circumferential surface.

In an embodiment, the axial ribs are at least essentially designed in an L-shape, wherein an arm is connected in a firmly bonded manner with the radial flange and the other arm is connected in a firmly bonded manner to the circumferential surface. In this way, possible crack propagation in an embodiment can be directed, particularly limited, both in the radial flange as well as in the circumferential surface with the least possible material cost. The arm connected to the radial flange, as explained above, may extend, particularly in a radial manner, outward at least to a radially inner end of a recess. Such an axial rib thus extends only in the region of the radial flange radially outward at least to the radial inner end. Similarly, an axial rib, seen in the peripheral direction, may also be designed for example, in a triangular, rectangular, U-shaped, or similar manner.

In an embodiment, the axial ribs extend or run at least essentially in an axial direction. Similarly, they may form an angle to the axial direction or a rotational axis of the turbomachine, which corresponds in an embodiment to a stagger angle of the guide vanes. For a more compact description, such diagonal ribs are also referred to as axial ribs within the meaning of the present invention. Axial ribs may run or axially extend in a straight or curved manner. Generally, in an embodiment, the axial ribs may be equally distant, at least generally, to the adjoining guide vanes in the peripheral direction. In particular, there may be a minimal clearance in the peripheral direction between an axial rib of an axial rib pair and the guide vane adjoining it that is at least essentially equal to the minimum clearance in the peripheral direction between the other axial rib of this axial rib pair and the guide vane adjoining it.

The axial ribs may extend in an embodiment from a rear to a front radial flange. In another embodiment, the axial ribs, particularly originating from a rear radial flange, end axially in front of another radial flange, particularly a front one. It has been shown that as a result of this, conventional cracks can be sufficiently controlled and the cost of materials can be minimized as well.

In an embodiment, the axial ribs are connected to the circumferential surface and/or the radial flange in a fillet. This can impede a crack from crossing over the ribs.

In an embodiment, the circumferential surface in the peripheral direction between the axial ribs is sunken in radially inwards. In this way, a possible crack can also be directed between the axial rib pair. Similarly, in an embodiment, the circumferential surface can be raised radially outwards in a peripheral direction between the axial ribs, particularly thickened between the axial ribs, to impede a crack from progressing. Particularly outside of the axial rib pairs—and in an enhanced embodiment, also between the axial rib pairs—the circumferential surface between the axial rib pairs can have at least essentially the same wall thickness as the radial flange.

In an embodiment, the axial ribs can be produced separately and subsequently be connected in a firmly bonded manner, welded in particular, to the circumferential surface and/or the radial flange. Similarly, they may be produced by deposition welding or be gauged to the circumferential surface and/or the radial flange.

Additional advantageous developments of the present invention emerge from the following description of the preferred embodiments. To this end, appearing in a partially schematized manner, are drawings.

DETAILED DESCRIPTION OF THE DRAWINGS

Figure 1:
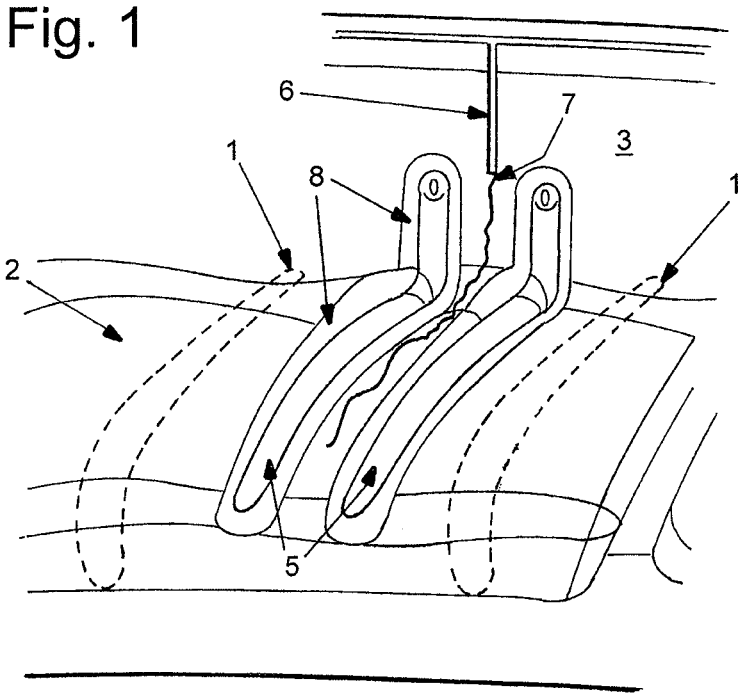
FIG. 1 illustrates a part of a guide vane arrangement of a gas turbine according to an embodiment of the present invention with an axial rib pair in a perspective view.
Figure 2:
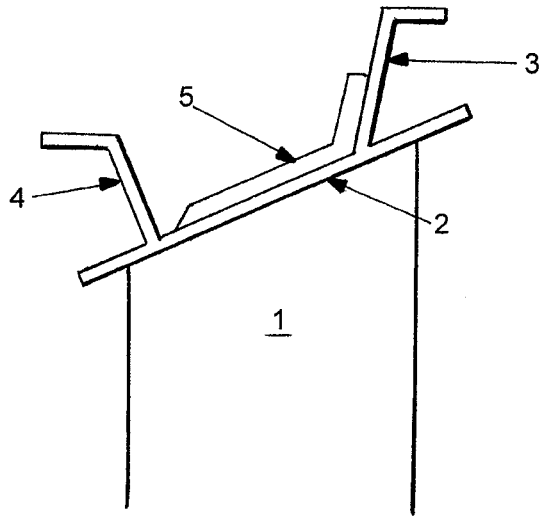
FIG. 2 is an axial cross-section between the axial rib pair of FIG. 1.

FIGS. 1 and 2 illustrate a part of a guide vane arrangement of a low-pressure compressor of an aircraft engine gas turbine according to an embodiment of the present invention in a perspective view and an axial cross-section, respectively.

The guide vane arrangement has an external shroud band from which several guide vanes 1 protrude radially inward (vertically downward in FIGS. 1 and 2). The footprints of guide vanes 1 are indicated by dashed lines in FIG. 1.

The external shroud band has an essentially conical circumferential surface 2, a rear radial flange 3 in the flow direction (from left to right in FIGS. 1 and 2), and a front radial flange 4 in the flow direction, where the front radial flange is omitted in FIG. 1. The external shroud band is hung in a housing (not depicted) by means of the front and rear radial flanges, as is disclosed for example in EP 1 462 616 A2, which is referred to in this respect and the disclosure of which is incorporated by reference herein.

Seen in the peripheral direction (perpendicular to the drawing plane of FIG. 2), there is arranged between the two adjoining guide vanes 1 a pair of axial ribs 5, which are spaced apart from each other in the peripheral direction and protrude radially outward from circumferential surface 2 of the external shroud band (vertically upward in FIGS. 1 and 2) and axially from radial flange 3 toward circumferential surface 2 (from right to left in FIG. 2) and are thus each welded to it.

In rear radial flange 3, there is formed by electrical discharge machining a slit-type recess 6, which extends essentially in a radial direction from a radial external border of the rear radial flange 3 (top in FIG. 1) and is provided for having a cooling fluid, particularly cooling air, flow through it.

The radial inner end (bottom in FIG. 1) of this cooling slit 6 forms a preferred incipient crack location for a crack 7.

Seen in the peripheral direction (in the top-down view of FIG. 2), axial ribs 5 are formed in an L-shape, where a first arm (right in FIG. 2) is connected to rear radial flange 3 in a firmly bonded manner and a second arm (bottom in FIG. 2) is connected to circumferential surface 2 in a firmly bonded manner. The first arm connected to rear radial flange 3 extends radially outward to the radial inner end of recess 6, which, when seen in the peripheral direction, is arranged between the two adjoining axial ribs 5. In this way, an expansion of crack 7 can be limited at its source between axial ribs 5 and be directed by these to radial flange 3 and into circumferential surface 2.

Axial ribs 5 extend essentially in an axial direction or parallel to a stagger angle of guide vane guides 1 and are equidistant from the adjoining guide vane guides 1 in the peripheral direction.

Originating from rear radial flange 3, axial ribs 5 end axially in front of front radial flange 4 (see FIG. 2). It has been shown that in this way, conventional cracks can be sufficiently controlled and the material cost of the axial ribs can also be minimized.

The axial ribs are connected to circumferential surface 2 and rear radial flange 3 in a fillet 8. In this way, a crack 7 can be impeded from crossing ribs 5.

Circumferential surface 2 is slightly sunken in radially inwards in the peripheral direction between axial ribs 5.

Even though in the preceding description, sample embodiments were explained, it shall be pointed out that a plurality of variations is possible. In addition, it is pointed out that the sample embodiments are only examples that are not meant to limit in any way the protective scope, the applications, and the construction. Rather, by means of the preceding description, a person skilled in the art is given a guide for implementing at least a sample embodiment, wherein various changes, particularly in regard to the function and arrangement of the described components, may be undertaken without departing from the protective scope, as it emerges from the claims and these equivalent combinations of features.

LIST OF REFERENCE NUMBERS

1 Guide vane
2 Circumferential surface
3 Rear radial flange
4 Front radial flange
5 Axial rib
6 Cooling slit
7 Crack
8 Fillet As also discussed above, the foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A guide vane arrangement for a turbomachine, comprising:

an external shroud band including a single, continuous circumferential surface and a radial flange;

at least two guide vanes that protrude radially inward from the external shroud band; and a pair of axial ribs, each axial rib of the pair of axial ribs being attached to the single, continuous circumferential surface such that the one axial rib is spaced apart from the other axial rib along the single, continuous circumferential surface in a peripheral direction, the attached pair of axial ribs being disposed in the external shroud band between two adjoining guide vanes in the peripheral direction, wherein each axial rib of the pair of axial ribs protrudes radially outward from the circumferential surface and axially from the radial flange, wherein the pair of axial ribs are each formed in an L-shape in the axial direction, and wherein each of the axial ribs have a first arm that is bonded to the radial flange and a second arm that is bonded to the circumferential surface.

2. The guide vane arrangement according to claim 1, wherein the pair of axial ribs extend, at least in a region of the radial flange, radially outward at least to a radial inner end of a recess in the radial flange.

3. The guide vane arrangement according to claim 2, wherein the recess is a slit.

4. The guide vane arrangement according to claim 1, wherein the pair of axial ribs end in front of an additional radial flange of the external shroud band.

5. The guide vane arrangement according to claim 1, wherein the circumferential surface is sunken in radially inwards in the peripheral direction between the pair of axial ribs.

6. The guide vane arrangement according to claim 1, wherein the pair of axial ribs are welded to the circumferential surface and/or the radial flange in a fillet or produced by deposition welding.

7. A gas turbine, comprising:

at least one compressor and/or turbine stage with the guide vane arrangement according to claim 1, wherein the guide vane arrangement is connected by the radial flange to a housing of the gas turbine.

8. The gas turbine according to claim 7, wherein the gas turbine is an aircraft engine gas turbine.

9. The gas turbine according to claim 7, wherein the guide vane arrangement is detachably connected by the radial flange to the housing of the gas turbine.

10. A guide vane arrangement for a turbomachine, comprising:

an external shroud band including a single, continuous circumferential surface and a radial flange;

at least two guide vanes that protrude radially inward from the external shroud band; and a pair of axial ribs, each axial rib of the pair of axial ribs being attached to the single, continuous circumferential surface such that the one axial rib is spaced apart from the other axial rib along the single, continuous circumferential surface in a peripheral direction, the attached pair of axial ribs being disposed in the external shroud band between two adjoining guide vanes in the peripheral direction, wherein each axial rib of the pair of axial ribs protrudes radially outward from the circumferential surface and axially from the radial flange and wherein the pair of axial ribs are welded to the circumferential surface and/or the radial flange in a fillet.

* * * * *